US005386707A

United States Patent [19]

Schulte et al.

[11] Patent Number: 5,386,707

[45] Date of Patent: Feb. 7, 1995

[54] WITHDRAWAL OF CRYOGENIC HELIUM WITH LOW IMPURITY FROM A VESSEL

[75] Inventors: Thomas R. Schulte; Robert E. Goelz, Jr., both of Grand Island, N.Y.

[73] Assignee: Praxair Technology, Inc., Danbury, Conn.

[21] Appl. No.: 999,430

[22] Filed: Dec. 31, 1992

[51] Int. Cl.[6] ..... F17C 9/02

[52] U.S. Cl. ..... 62/50.2; 62/51.1

[58] Field of Search ..... 62/50.1, 51.1

[56] References Cited

U.S. PATENT DOCUMENTS

| | | | |
|---|---|---|---|
| 3,123,981 | 3/1964 | Carney et al. | 62/51 |
| 4,315,407 | 2/1982 | Creed et al. | 62/53 |
| 4,519,213 | 5/1985 | Brigham et al. | 62/52 |
| 4,559,786 | 12/1985 | Schuck | 62/55 |
| 4,637,216 | 1/1987 | Shenoy et al. | 62/54 |
| 4,744,222 | 5/1988 | Murai | 62/50.1 |
| 4,766,731 | 8/1988 | Graczyk et al. | 62/55 |
| 4,877,153 | 10/1989 | Varghese et al. | 220/469 |

OTHER PUBLICATIONS

Transient Shielded Cryogenic Containers, by A. P. Varghese and B. X. Zhang Supercollider 3, pp. 891–899, Premium Press, New York 1991.

*Technology of Liquid Helium*, National Bureau of Standards Monograph 111, pp. 223–248.

*Primary Examiner*—Henry A. Bennett

*Attorney, Agent, or Firm*—Peter Kent; Chung K. Pak

[57] ABSTRACT

A method for withdrawing from a vessel pressurized cryogenic helium fluid with an objectionable impurity concentration of less than 5 ppmv. The method comprises pressurizing at or near the top of the vessel with helium fluid from an external source having a concentration of up to 1000 ppmv of the objectionable impurity, and withdrawing from a port near the bottom of a vessel helium fluid at a cryogenic temperature below the temperature at which the withdrawn fluid has an objectionable impurity of 5 ppmv.

13 Claims, 1 Drawing Sheet

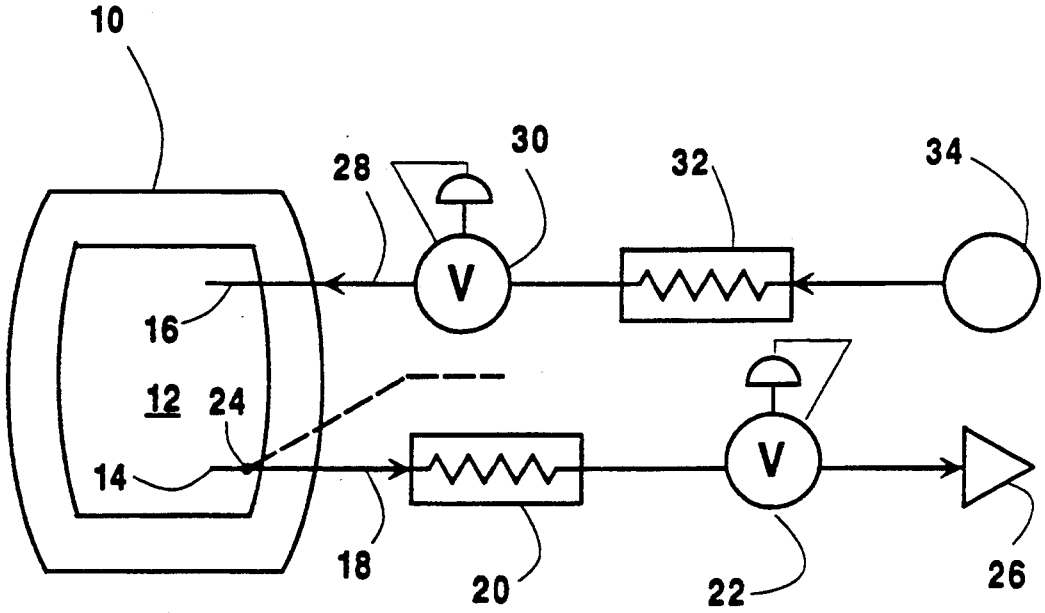
10
28
30
32
34
V
16
12
24
14
V
18
20
22
26

WITHDRAWAL OF CRYOGENIC HELIUM WITH LOW IMPURITY FROM A VESSEL

BACKGROUND

This invention relates generally to the delivery of helium fluid at high purity to a usage location.

When large quantities of industrial gases, such as nitrogen, oxygen, argon and hydrogen are required at a usage location, they are commonly transported from the production plant as liquified gases and transferred to a storage tank at the usage site. The pressure in the storage tank may be allowed to increase to the maximum working pressure of the storage tank by natural evaporation and by induced evaporation of a quantity of liquid in an external or internal heater. The liquified gas is withdrawn at the tank pressure for use as needed, pumped to a higher pressure if required, vaporized and warmed if desired.

Helium is not amenable to such practice. Since helium has a very low heat of vaporization and boils at a very low temperature, liquid helium pumps are not viable because of heat leak and vaporization during the pumping operation. Even during transfer by pressure differential from a transport vessel to a storage tank at a usage site, excessive vaporization of helium liquid occurs during cooling of the storage tank and associated piping with attendant excessive loss of gaseous helium.

Consequently common practice is to transport helium as a liquid to a transfill site in a liquid trailer, vaporize the liquid and compress the resulting gas into high pressure cylinders for delivery to the user site. This process often results in contamination of the helium stored in or drawn from the cylinders with trace amounts of air and moisture. If high purity helium is desired at the user site, an expensive purification system is installed to remove the contaminants.

An alternative is to transport helium directly to the usage site as liquid in an insulated vessel, allow the vessel to remain at the usage site and withdraw helium from the vessel by pressure differential as needed for use. The pressure in the vessel may be allowed to increase to the maximum working pressure of the vessel by natural evaporation and by induced evaporation with a heater. The heater may be external and require a circulation of a fluid stream of helium through the heater, or the heater may be internal such as an electrical element. In either case, additional complexity and cost are required and are disadvantageous.

As an alternative to the heater, U.S. Pat. No. 4,766,731 describes pressurization of a liquid helium container with gaseous helium from an external source by bubbling the additional gaseous helium through the cold helium fluid in the container in order to cool this additional helium to the temperature of the fluid in the container. This procedure destroys or reduces the natural temperature stratification that develops in a container of liquid helium. Also the additional gaseous helium must remain in heat exchange relation with the cold helium fluid in the container for a period of time sufficient to be cooled before fluid delivery to the user occurs. Alternatively, according to this patent, the additional gaseous helium may be passed in indirect heat exchange relationship with the cold helium fluid in the container to cool it to the temperature of the fluid in the container, and then released into the container or into the supply line leading to the usage location. This latter procedure requires a heat exchanger for the indirect contact between the container fluid and the added helium gas.

The current invention has the advantage of allowing a standard liquid helium transport vessel without modification to be used for transporting liquid helium to a usage site. Another advantage is that helium fluid may be withdrawn simultaneously with the addition of pressurizing gas. Still another advantage is that the natural temperature stratification in the vessel is maintained. Thus a lesser quantity of additional relatively impure helium gas from an external source is required to pressurize the vessel for withdrawal and supply of high purity helium fluid to a usage location. In addition, a larger fraction of the helium fluid charged into the vessel may be withdrawn from the vessel as high purity helium fluid for delivery to the user.

SUMMARY

This invention provides a method for withdrawing with low concentrations of impurities a quantity of helium fluid from a vessel for delivery to a user, using, as necessary, a helium pressurizing gas containing concentrations of impurities greater than desired in the fluid withdrawn. The method comprises:

(a) providing a vessel containing cryogenic helium fluid;

(b) admitting at or near the top of the vessel from an external source helium pressurizing fluid having a concentration of at least one objectionable impurity greater than the limit desired in the helium fluid withdrawn from the vessel, the helium pressurizing fluid from the external source being admitted to a pressure in the vessel not less than that at the user;

(c) opening a port near the bottom of the vessel and withdrawing helium fluid at a temperature not greater than the temperature at which the concentration of the objectionable impurity equals the limit desired in the withdrawn helium fluid; and (d) conveying pressurized fluid from the port to the receiver.

In another variation of the method, the helium fluid is withdrawn at a temperature not greater than the temperature at which the vapor pressure of the solid phase of the objectionable impurity divided by the pressure of the fluid in the vessel reaches or equals the concentration limit of the objectionable impurity desired in the withdrawn helium fluid.

Where the helium pressurizing fluid has at;least two objectionable impurities, the helium fluid is withdrawn at a temperature not greater than the temperature at which the vapor pressure of the objectionable impurity having the highest vapor pressure divided by the pressure of the fluid in the vessel reaches or equals the concentration limit desired in the helium fluid withdrawn of the objectionable impurity having the highest vapor pressure.

Where the objectionable impurity is nitrogen, the pressure of the fluid in the vessel is at least atmospheric pressure, and the pressurizing fluid from an external source has a nitrogen concentration of from about 5 to about 1000 ppmv, the helium fluid is withdrawn near the bottom of the vessel at a temperature below 36° K. with an impurity concentration less than 5 ppmv.

Where the objectionable impurity is water, the pressure of the fluid in the vessel is at least atmospheric pressure, and the pressurizing fluid from an external source has a water concentration of from about 5 to about 1000 ppmv, the helium fluid is withdrawn near the bottom of the vessel at a temperature below 207° K. with a concentration of water less than 5 ppmv.

DRAWING

These and other features, aspects and advantages of the invention will become better understood with reference to the following description, appended claims and the accompanying sole figure which is a schematic drawing of apparatus useful for practicing the invention.

DESCRIPTION

The present invention is directed to a method for withdrawing proximate the bottom of a vessel containing cryogenic helium fluid a quantity of helium fluid with a low impurity concentration. Cryogenic as used herein shall mean at a temperature below approximately 210° K. The withdrawal motivation is by pressurization of the vessel to a pressure greater than that at the user or external receiver of the helium fluid. Pressurization is provided as required from an external source of helium fluid. The external source usually contains a greater concentration of at least one impurity than desired in the helium fluid withdrawn from the vessel.

Referring to the figure, a vessel 10, typically highly insulated, and typically capable of pressurization to a range of from approximately 500 to 1300 kPa, contains helium fluid 12. The vessel has a lower port 14 preferably near its bottom, that is, from about 1 to about 30 centimeters above the bottom. The vessel also has an upper port 16 preferably at or near its top, that is, from the top to about 30 centimeters below the top. Preferably the ports are vertically spaced to allow a temperature gradient to develop in the vessel contents between the ports.

The lower port 14 in the vessel opens to a lower conduit 18 optionally having a vaporizer 20 or heater, and optionally a pressure regulating valve 22. The lower port contains a temperature measurement device 24, such as a thermocouple, for measuring the temperature of the helium fluid withdrawn from the vessel. The lower conduit 18 leads to a user 26 which can be a direct user of the helium fluid or a receiver, such as another vessel. Use of the helium fluid withdrawn may be continuous or intermittent.

The upper port 16 in the vessel opens to an upper conduit 28 having a valve 30, which may be a pressure regulating valve, and optionally a heater 32. The upper conduit 28 leads to a source 34 of pressurized helium fluid, usually gas in a metal cylinder at ambient temperature. Another operable source is evaporated helium in a pressurized container of liquid helium.

In practice, the vessel is charged with cryogenic helium fluid, usually as a liquid, which has a boiling temperature of 4.2° K. at normal atmospheric pressure. Over time, heat leak into the vessel causes some evaporation of the helium liquid. The vapor is contained in the vessel, and the pressure in the vessel is allowed to build and may reach the allowable working pressure of the vessel. The helium fluid in the vessel will form two phases, liquid and vapor, if the temperature is less than the critical temperature of 5.3° K. and the pressure is less than the critical pressure of 220 kPa. The helium fluid in the vessel will form only one phase if the pressure is at or above the critical pressure.

Helium fluid is withdrawn from the vessel 10 through the lower port 14, and delivered through the lower conduit 18 to a user 26 as needed. The motivation for fluid flow is pressure difference between the vessel and the user. If the pressure in the vessel becomes too low as helium fluid is withdrawn from the lower port 14, helium pressurizing fluid is added to the vessel through the upper port 16.

Impurities may be present in the helium fluid charged to the vessel, may enter the helium fluid from the atmosphere during the charging operation, may infiltrate the helium in the vessel during storage, or may enter the vessel in the pressurizing gas. Typical impurities are atmospheric gases, such as water, carbon dioxide, oxygen, argon and nitrogen, any of which may be objectionable at some concentration level to a user because of some detriment occurring in the use of the helium. Typically the withdrawn helium fluid is desired with a low concentration of objectionable impurity or impurities, usually less than 5 ppmv, and sometimes not greater than 1 ppmv.

The impurities mentioned, in solid or liquid form, are much denser than liquid helium or cryogenic supercritical helium. Consequently such impurities in liquid helium or cryogenic supercritical helium are usually predominantly present on the bottom of the containing vessel or deposited on the walls of the vessel. An impurity typically has a low solubility in the cryogenic helium liquid. An impurity also has a low vapor pressure, which causes the impurity to contaminate the helium vapor or the cryogenic supercritical helium fluid. However, even though a vessel 10 containing cryogenic helium may have an impurity, helium fluid is made available with a low concentration of the impurity by the practice of the present invention. The helium fluid is withdrawn from the lower port 14 at a temperature not greater than the temperature at which the concentration of the impurity in the fluid being withdrawn equals the limit desired or allowable.

A temperature of significance with respect to an impurity concentration in the fluid withdrawn is the freezing temperature of the impurity. An impurity within the vessel is likely to be deposited on the surface of the vessel and on the bottom of the vessel. Should the temperature of the fluid in the vessel rise above the freezing temperature of the impurity, the impurity may be freed into the fluid in the vessel and emerge with the fluid withdrawn from the lower port 14 of the vessel. Thus helium fluid may be withdrawn from the lower port 14 with an impurity concentration which may be sufficiently low for a particular use so long as the temperature of the helium at the lower port is below the freezing temperature of the impurity.

A still lower concentration of impurity may be achieved by withdrawing helium at a temperature not greater than the temperature at which the vapor pressure of the impurity causes the impurity in the fluid withdrawn to reach or equal the concentration limit desired or allowable. Impurities which might be present in helium and the respective approximate temperatures at which the impurity vapor pressure causes the impurity to reach a concentration of 5 ppmv in helium fluid at atmospheric pressure are: water, 207° K.; carbon dioxide, 111° K.; oxygen, 42° K.; argon, 42° K.; and nitrogen, 36° K. The respective approximate temperatures at which the impurity reaches a concentration of 1 ppmv in helium fluid at atmospheric pressure are: water, 197° K.; carbon dioxide, 105° K.; oxygen, 39° K.;

argon, 39° K.; and nitrogen, 34° K. For comparison, the respective approximate temperatures at which the impurity reaches a concentration of 5 ppmv in helium fluid at an absolute pressure of 689 kPa are: water, 222° K.; carbon dioxide, 119° K.; oxygen, 45° K.; argon, 45° K.; and nitrogen, 39° K. The respective approximate temperatures at which the impurity reaches a concentration of 1 ppmv in helium fluid at an absolute pressure of 689 kPa are: water, 211° K.; carbon dioxide, 113° K.; oxygen, 42° K.; argon, 42° K.; and nitrogen, 37° K. If several of these impurities are present in significant concentration, helium may be withdrawn from the lower port 14 so long as the withdrawal temperature is not greater than the temperature at which the impurity with the highest vapor pressure reaches the concentration limit in the helium fluid. Inasmuch as water, carbon dioxide, nitrogen and oxygen are typical objectionable impurities which may be present in significant concentration in helium, and nitrogen is the most volatile, withdrawal may continue so long as the withdrawal temperature is not greater than the temperature at which nitrogen reaches the objectionable concentration limit in the helium fluid withdrawn. The fluid being withdrawn in this process will have concentrations of the other mentioned impurities lower than the specified concentration limit for nitrogen.

The concentration of an impurity in cryogenic helium vapor or cryogenic supercritical fluid at a given temperature and pressure may be estimated by dividing the vapor pressure exerted by the solid phase of the impurity at the given temperature by the given pressure of the helium vapor or supercritical fluid. Thus in the practice of this invention, withdrawal may continue so long as the withdrawal temperature is not greater than the temperature at which the vapor pressure of the solid phase of the objectionable impurity divided by the pressure of the fluid in the vessel reaches or equals the concentration limit of objectionable impurity desired in the helium fluid withdrawn.

Usually a vertical temperature gradient develops naturally and exists in the vessel, so that the lower port 14 located proximate the bottom of the vessel withdraws the coldest helium fluid from the vessel. Accordingly, the temperature of the helium fluid above the lower port 14 is usually warmer than the temperature at the port. Hence if the temperature as measured anywhere in the vessel is not greater than the temperature desired at the withdrawal port 14, withdrawal may proceed. Thus the temperature may be measured alternatively in the vessel itself, or at the lower port, or in the lower conduit.

Temperature measurement may be performed in alternate ways to measurement with a thermocouple. For instance, the pressure and density of the fluid in the vessel may be ascertained and related to its temperature through published tables or charts of properties of state for helium. A convenient way to ascertain density is to measure the pressure differential between two known elevations on the vessel and the pressure at one of the elevations.

An alternate to ascertaining temperature of the fluid withdrawn from a vessel in order to control impurity concentration is to measure the concentration of the impurity itself in the withdrawn fluid. The concentration of oxygen in helium, for example, is readily measurable with existing available instrumentation. Thus so long as the concentration of impurity is not greater than that desired in the helium fluid withdrawn, withdrawal may proceed.

The pressure in the vessel provided by charging and by natural evaporation of liquid helium may be sufficient initially to supply adequate withdrawal flow. However as withdrawal proceeds, the pressure in the vessel may decrease and may need to be supplemented to maintain adequate differential for withdrawal. Supplementary pressurizing helium fluid is admitted as necessary from the source 34 into the vessel 10. The supplementary pressurizing fluid may be admitted at any temperature at which it is available, ambient temperature being most common. Optionally, the supplementary gas prior to entering the vessel may be warmed in the heater 32, whereby a lesser quantity of supplementary gas is necessary.

Typically, the supplementary pressurizing helium fluid from the source has a greater impurity concentration than desired in the helium fluid to be withdrawn from the vessel, typically an impurity concentration of from about 5 ppmv to about 1000 ppmv of the types mentioned above. Since the supplementary pressurizing gas is admitted near the top of the vessel, its composition does not immediately affect the composition of the fluid withdrawn near the bottom of the vessel. As the supplementary pressurizing helium fluid admitted to the top of the vessel is cooled within the vessel, its impurities are condensed or solidified. The impurities deposit on the surfaces of the vessel, or drop out to the bottom of the vessel because they are much denser than the cold helium fluid in the vessel. Thus the supplementary pressurizing helium fluid becomes purified and itself available for withdrawal and supply to the usage location.

Natural temperature stratification occurs in the vessel, the colder fluid residing at the bottom. Admission of the relatively warm pressurizing gas to or near the top of the vessel tends to establish and promote the temperature stratification, and to delay or retard cooling of the admitted gas. Thus the deposit of impurities from the admitted pressurizing gas into the vessel contents is delayed and retarded. The withdrawal of fluid near the bottom may occur simultaneously with admission of supplementary pressurizing fluid near the top of the vessel. Less pressurizing gas is needed if the gas is admitted near the top of the vessel than if the gas were admitted at the bottom of the vessel where its cooling and vessel contents mixing would be initiated and promoted.

Upon depletion of the vessel to a low content of helium, the vessel, without purging, may be recharged with helium from an external supply such as a tank truck or a production plant. In practice, the vessel itself may be part of a tank truck which is filled at a production plant, driven to a usage site, depleted, and returned to the plant for replenishment without purging.

Although certain preferred embodiments of the present invention have been described, the spirit and scope of the invention is not restricted to what is described above. For example, it is apparent that pressurizing gas need not be admitted at the top of the vessel and that withdrawal need not occur at or near the bottom of the vessel so long as a vertical space difference exists between the lower and upper ports where these functions occur so as to allow temperature stratification.

What is claimed is:

1. A method for withdrawing a quantity of helium fluid from a vessel for delivery to a user, said method comprising:

(a) providing a vessel containing cryogenic helium fluid;

(b) admitting near the top of the vessel from an external source helium pressurizing fluid having a concentration of at least one objectionable impurity greater than the limit desired in helium fluid withdrawn from the vessel, the helium pressurizing fluid from the external source being admitted to a pressure in the vessel not less than that at the user;

(c) opening a port near the bottom of the vessel and withdrawing helium fluid at a temperature not greater than the temperature at which the concentration of said at least one objectionable impurity equals the limit desired in said withdrawn helium fluid; and (d) conveying said withdrawn helium fluid from said port to the user.

2. The method as in claim 1 wherein said helium pressurizing fluid has at least two objectionable impurities and said helium fluid is withdrawn at a temperature not greater than the temperature at which the vapor pressure of the objectionable impurity having the highest vapor pressure divided by the pressure of the fluid in the vessel reaches the concentration limit desired in the helium fluid withdrawn from the vessel of said objectionable impurity having the highest vapor pressure.

3. The method as in claim 1 wherein said at least one objectionable impurity is nitrogen, the pressure of the fluid in the container is at least at atmospheric pressure, and the helium fluid is withdrawn at a temperature not greater than approximately 34° K.

4. The method as in claim 1 wherein said at least one objectionable impurity is nitrogen, the pressurizing fluid from an external source has a nitrogen concentration of from about 5 to about 1000 ppmv, the pressure of the fluid in the container is at least atmospheric pressure, and the helium fluid is withdrawn at a temperature below approximately 37° K. with a concentration of nitrogen less than 5 ppmv.

5. The method as in claim 1 wherein the objectionable impurity is nitrogen, the pressurizing fluid from an external source has a nitrogen concentration of from about 5 to about 1000 ppmv, the pressure of the fluid in the container is at least atmospheric pressure, and the helium fluid is withdrawn at a temperature not greater than approximately 34° K. with a concentration of nitrogen not greater than 1 ppmv.

6. The method as in claim 1 wherein said objectionable impurity is water, the pressure of the fluid in the vessel is at least atmospheric pressure, the pressurizing fluid from an external source has a water concentration of from about 5 to about 1000 ppmv, and the helium fluid is withdrawn at a temperature below approximately 197° K. with a concentration of water less than 1 ppmv.

7. The method of claim 1 further comprising the step of replenishing the vessel with helium fluid when depleted without purging the vessel.

8. The method of claim 1 wherein the helium fluid from the external source is supplied as a gas or supercritical fluid.

9. The method as in claim 1 wherein said at least one objectionable impurity is oxygen, the, pressure of the fluid in the container is at least atmospheric pressure, and helium fluid is withdrawn at a temperature not greater than approximately 39° K.

10. The method as in claim 1 wherein said at least one objectionable impurity is oxygen, the pressurizing fluid from an external source has a oxygen concentration of from about 5 to about 1000 ppmv, the pressure of the fluid in the container is at least atmospheric pressure, and the helium fluid is withdrawn at a temperature below approximately 42° K. with a concentration of oxygen less than 5 ppmv.

11. The method as in claim 1 wherein said at least one objectionable impurity is oxygen, the pressurizing fluid from an external source has a oxygen concentration of from about 5 to about 1000 ppmv, the pressure of the fluid in the container is at least at atmospheric pressure, and the helium fluid is withdrawn at a temperature not greater than approximately 39° K. with a concentration of oxygen not greater than 1 ppmv.

12. The method as in claim 1, further comprising monitoring the temperature of the helium fluid in said vessel or in said port near the bottom of said vessel, and controlling the concentration of said at least one objectionable impurity in said withdrawn helium fluid based on the monitored temperature.

13. A method for withdrawing a quantity of helium fluid from a vessel for delivery to a user, said method comprising:

(a) providing a vessel containing cryogenic helium fluid;

(b) admitting near the top of the vessel from an external source helium pressurizing fluid having a concentration of at least one objectionable impurity greater than the limit desired in helium fluid withdrawn from the vessel, the helium pressurizing fluid from the external source being admitted to a pressure in the vessel not less than that at the user;

(c) opening a port near the bottom of the vessel and withdrawing helium fluid at a temperature not greater than the temperature at which the vapor pressure of said at least one objectionable impurity divided by the pressure of the fluid in the vessel reaches the concentration limit of said objectionable impurity desired in said withdrawn helium fluid; and (d) conveying said withdrawn helium fluid from said port to the user.

* * * * *